US005918799A

United States Patent [19]

Walsh

[11] Patent Number: 5,918,799

[45] **Date of Patent: *Jul. 6, 1999**

[54] CARTON, CARTON BLANK AND METHOD FOR FORMING THE CARTON

[75] Inventor: Joseph C. Walsh, Longmont, Colo.

[73] Assignee: Graphic Packaging Corporation, Paoli, Pa.

[ * ] Notice: This patent is subject to a terminal disclaimer.

[21] Appl. No.: 08/886,683

[22] Filed: Jul. 1, 1997

Related U.S. Application Data

[63] Continuation-in-part of application No. 08/741,342, Oct. 29, 1996, Pat. No. 5,794,811.

[51] Int. Cl.[6] ..... B65D 5/56

[52] U.S. Cl. ..... 229/164.2; 229/117.33; 53/491; 493/183

[58] Field of Search ..... 229/117.3, 117.32, 229/117.33, 117.35, 164.2, 198.2; 493/96, 97, 162, 183; 53/485, 491

[56] References Cited

U.S. PATENT DOCUMENTS

| | | | |
|---|---|---|---|
| 1,845,891 | 2/1932 | Schroeder | 229/198.2 |
| 2,196,243 | 3/1940 | Bensel | 229/5.81 |
| 2,305,371 | 12/1942 | Yates | 229/117.33 |
| 2,363,425 | 11/1944 | Klein . | |
| 2,381,026 | 8/1945 | Arthur | 229/117.32 |
| 2,416,332 | 2/1947 | Lehman | 229/125.32 |
| 2,550,520 | 4/1951 | Bennett | 229/198.2 |
| 2,996,235 | 8/1961 | Turpin | 229/125.34 |
| 3,078,768 | 2/1963 | Kuchenbecker | 229/164.2 |
| 3,113,712 | 12/1963 | Kindseth | 229/117.32 |
| 3,194,471 | 7/1965 | Murphy | 229/117.33 |
| 3,198,416 | 8/1965 | Hickin et al. | 229/164.2 |
| 3,288,345 | 11/1966 | Dilot | 229/164.2 |
| 3,561,667 | 2/1971 | Saltman | 229/117.32 |
| 3,640,447 | 2/1972 | Forbes, Jr. et al. | 229/164.2 |
| 3,910,482 | 10/1975 | Bamburg et al. | 229/122.32 |
| 3,951,333 | 4/1976 | Forbes, Jr. et al. | 229/207 |
| 4,053,102 | 10/1977 | Stark | 229/199 |
| 4,077,309 | 3/1978 | Marbot | 493/183 |
| 4,139,119 | 2/1979 | McLaren | 229/117.33 |
| 4,171,064 | 10/1979 | Friess et al. | 229/5.82 |
| 4,189,986 | 2/1980 | Silver | 493/183 |
| 4,254,173 | 3/1981 | Peer, Jr. | 206/158 |
| 4,471,884 | 9/1984 | Kuchenbecker | 229/164.2 |
| 4,526,314 | 7/1985 | Reil | 229/199 |
| 4,720,015 | 1/1988 | Brauner | 229/125.34 |
| 4,768,703 | 9/1988 | Sosler et al. | 229/125.34 |
| 4,771,983 | 9/1988 | Hambleton | 229/125.34 |
| 4,890,772 | 1/1990 | Heuberger et al. | 229/117.3 |
| 4,927,075 | 5/1990 | Lisiecki | 493/183 |
| 5,794,811 | 8/1998 | Walsh | 229/198.2 |

FOREIGN PATENT DOCUMENTS

| | | | |
|---|---|---|---|
| 239316 | 9/1987 | European Pat. Off. . | |
| 71594 | 5/1957 | France | 53/491 |
| 1516536 | 1/1968 | France . | |
| 208467 | 3/1909 | Germany . | |
| 451579 | 3/1975 | Russian Federation | 53/491 |
| 176994 | 3/1922 | United Kingdom . | |

*Primary Examiner*—Gary E. Elkins
*Attorney, Agent, or Firm*—Klaas, Law, O'Meara & Malkin, P.C.; William P. O'Meara, Esq.; Joseph J. Kelly, Esq.

[57] ABSTRACT

A carton blank and a leakproof carton formed therefrom which carton has an outer enclosure formed from a relatively rigid material and having an openable top portion and a closed bottom portion and a leakproof inner liner having a central body portion secured to an opposed central body of the outer enclosure, a closed bottom and an openable closed top so that after portions of the material in the carton have been removed the top portion and adjacent portions of the inner liner's central body may be separated from the central body of the outer enclosure and folded downwardly to protect the remaining material in the carton. In one embodiment, after all the material has been removed from the carton, the leakproof inner liner may be completely removed from the outer enclosure.

7 Claims, 2 Drawing Sheets

CARTON, CARTON BLANK AND METHOD FOR FORMING THE CARTON

This application is a continuation-in-part application of U.S. patent application Ser. No. 08/741,342 filed Oct. 29 1996, now U.S. Pat. No. 5,794,811 issued Aug. 18, 1998.

FIELD OF THE INVENTION

This invention is directed generally to carton blanks and apparatus and method for forming the carton blanks and more particularly to apparatus and method for forming carton blanks that can be used to form leakproof cartons having reclosable inner portions to form an effective seal after the leakproof carton has been opened.

BACKGROUND OF THE INVENTION

There are many supposedly leakproof cartons on the market today. These are formed using a variety of methods. Some of the cartons are designed to hold granular materials while others are designed to hold liquid materials. While some of these leakproof cartons have been successful, there is always a need for improvement including the formation of the top inner portion.

BRIEF DESCRIPTION OF THE INVENTION

This invention provides a carton blank and a leakproof carton formed therefrom wherein, after the leakproof carton has been opened, a top body portion and successive incremental portions of a central body portion of a relatively flexible fluid impervious material may be folded downwardly into the leakproof carton as portions of the material are removed from the leakproof carton to protect the remaining portions of the material in the carton and wherein, after all the material has been removed, the relatively flexible fluid impervious material may be removed.

In a preferred embodiment of the invention, the carton blank comprises a unitary sheet of a relatively rigid material having an inner surface and an outer surface, a left side edge, a right side edge, a top edge and a bottom edge. The unitary sheet of a relatively rigid material has a length extending from the top edge to the bottom edge and width extending from the left side edge of the right side edge. The unitary sheet of a relatively rigid material has a plurality of cut and fold lines for dividing the unitary sheet of a relatively rigid material into a back panel, a front panel, opposite sidewall panels, a glue tab panel and top and bottom panels extending outwardly in opposite directions from the front, back and opposite sidewall panels. The glue tab panel has a top edge and a bottom edge and a perforated line extending from the top edge toward the bottom edge and in some instances completely to the bottom edge. The inner surface defined by the front panel, the back panel, the opposite sidewall panels and the glue tab panel has a central body portion, a top body portion and a bottom body portion with the central body portion located between and spaced from the fold lines between the front panel, the back panel and the opposite sidewall panels and the top and bottom panels and extending into the glue tab panel. A generally rectangular sheet of a relatively flexible fluid impervious material is provided and has an inner surface and an outer surface, a central body portion, a top body portion, a bottom body portion, a left side edge, a right side edge and top and bottom edges. The generally rectangular sheet of a relatively flexible fluid impervious material has a length and a width which corresponds to the length and the width of the unitary sheet of a relatively rigid material. The central body portion of the rectangular sheet of a relatively flexible fluid sheet of a relatively flexible fluid impervious material is secured to the central body portion of the front panel, the back panel, the opposite sidewall panels and the glue tab panel. At least portions of the central body portion of the generally rectangular sheet of a relatively flexible fluid impervious material are secured by an adhesive permitting separation thereof from adjacent portions of the central body portion of the front panel, the back panel, the opposite sidewall panels and the glue tab panel without damage thereto by the application of sufficient force which portions extend downwardly from the top of the central body portion toward the bottom body portion thereof and, in some instances, to the bottom body portion. At least portions of the top and bottom body portions of the generally rectangular sheet of a relatively flexible fluid impervious material overlie but are not secured to the top and bottom body portions of the front panel, the back panel, the opposite sidewall panels and the top and bottom panels. Preferably, a sheet of a relatively flexible material is secured to the top and bottom body portions of the generally rectangular sheet of a relatively flexible fluid impervious material.

The portion of the glue tab panel between the perforated line and one of the left or right side edges is secured to the central body portion of the generally rectangular sheet of a relatively flexible fluid impervious material with an adhesive so that the portion moves with the at least portions of the central body portion of the rectangular sheet of a relatively flexible fluid impervious material as the at least portions are being separated from the central body portion of the front panel, the back panel, the opposite sidewall panels and the adjacent portion of the glue tab panel.

During the formation of the above-described carton blank into an open ended enclosure, a portion of the outer surface of the glue tab panel is skived away and a fold line extending form the top edge to the bottom edge of the glue tab panel is formed therein. The remaining portion has a thickness equal to about one-half of its original thickness.

A portion of the central body portion of the generally rectangular sheet of a relatively flexible fluid impervious material adjacent to one of the left or right side edge thereof is removed leaving a portion of the inner surface of the central body portion of the unitary sheet of a relatively rigid material exposed.

The open ended enclosure is formed by first folding on of the opposite sidewall panels and the glue tab panel around the foldline between the one of the opposite sidewall panels and the front or back panel. During this folding operation, the skived away portion around the fold line therein is form a continuous exposed strip of the relatively flexible fluid impervious material extending from the top edge to the bottom edge of the generally rectangular sheet. During the folding operations, a suitable adhesive is applied to the appropriate portions of the carton blank so that in the formed open ended enclosure the exposed portion of the inner surface of the central body portion of the unitary sheet of a relatively rigid material is secured to the non-skived portion of the glue tab panel, including the perforated line and the continuous strip of the relatively flexible fluid impervious material is secured to a superposed portion of the relatively flexible fluid impervious material that the open ended enclosure has a continuous inner surface.

In forming and filling a carton from the open ended enclosure, the bottom body portion of the generally rectangular sheet of a relatively flexible fluid impervious material is folded and secured together and the bottom panel portions are folded and secured together to form a bottom closed end so that the carton can be filled with a desired material. After being filled, the top body portion of the generally rectangular sheet of a relatively flexible fluid impervious material is folded and secured together and the top panel portions are folded and secured together to form a closed top end.

A method of forming an opened ended enclosure from the carton blank described above comprising folding the glue tab panel and one of the opposite sidewall panels and the portion of the generally rectangular sheet of a relatively flexible fluid impervious material secured thereto around a fold line between the one of the opposite sidewall panels and one of the front or back wall panels and forming extended fold lines in the top and bottom body portion of the generally rectangular sheet of a relatively flexible fluid impervious material; folding the at least portions of the glue tab panel located between the perforated line and the one of the left or right side edges and the other portions of the generally rectangular sheet of a relatively flexible fluid impervious secured thereto around the fold line in the glue tab panel and extending the fold line to include portions of the top and bottom body portions of the generally rectangular sheet of a relatively flexible fluid impervious material to form a continuous strip of the generally rectangular sheet of a relatively flexible fluid impervious material facing in the same direction as the outer surface of the remaining portion of the outer surface of the glue tab panel; folding the other of the front or back wall panels and the portion of the generally rectangular sheet of a relatively flexible fluid impervious material secured thereto around a fold line between the other of the front or back panels and the other of the opposite sidewall panels and forming extended fold lines in the top and bottom body portions of the generally rectangular sheet of a relatively flexible fluid impervious material and sealing together facing portions of the outer surface of the glue tab panel and the exposed inner surface of the other of the front or back panels and facing the continuous strip of a relatively flexible fluid impervious material and portions of the generally rectangular sheet of a relatively flexible fluid impervious material secured to the other of the front or back panels and the extensions thereof into the top and bottom body portions of the generally rectangular sheet of a relatively flexible fluid impervious material to form an open ended enclosure having a continuous inner surface formed from the generally rectangular sheet of a relatively flexible fluid impervious material.

The method further comprises forming a carton from the open ended enclosure comprising sealing together portions of the bottom body portion of the generally rectangular sheet of a relatively flexible material and the bottom panels to formed a carton having an open top and closed bottom filling the enclosure with a desired material and sealing together portions of the top body portion of the generally rectangular sheet of a relatively flexible fluid impervious material and the top panels to form a closed top.

The method further comprising opening the top panel portion and the portions of the top body portion of the generally rectangular sheet of a relatively flexible fluid impervious material removing some of the material form the carton; folding the top body portion and portions the central body portion of the generally rectangular sheet of a relatively flexible fluid impervious material to reclose the opening and severing the at least portions of the glue tab panel along the perforated line so that the portion of the glue tab panel may be folded with the central body portion of the generally rectangular sheet of a relatively flexible fluid impervious material. When all the material has been removed form the carton, the method further comprise separating the generally rectangular sheet of a relatively flexible material completely from the unitary sheet of a relatively rigid material.

In another embodiment of the invention, the carton blank comprises a unitary sheet of a relatively rigid material having an inner surface and an outer surface and a left side edge, a right side edge, a tope edge and a bottom edge and a length extending from the top edge to the bottom edge and a width extending from the left side edge to the right side edge. The unitary sheet of a relatively rigid material has a plurality of cut and fold lines for dividing the unitary sheet of a relatively rigid material into a back wall panel, a front wall panel, opposite sidewall panels, a glue tab panel and top and bottom panels extending outwardly in opposite directions from the front wall, back wall and opposite sidewall panels. The glue tab panel has a top edge and a bottom edge. A generally rectangular sheet of a relatively flexible fluid impervious material has an inner surface and an outer surface, a central body portion, a top body portion a bottom body portion, a left side edge, a right side edge and top and bottom edges and a length and a width corresponding to the length and the width of the unitary sheet of a relatively rigid material. The central body portion of the rectangular sheet of a relatively flexible fluid impervious material is secured to opposed portions of the front wall panel, the back wall panel, the opposite sidewall panels and the glue tab panel. At least portions of the central body portion of the generally rectangular sheet of a relatively flexible fluid impervious material are secured to opposed portions of the front panel, the back panel, and the opposite sidewall panels by a relatively weak adhesive which functions to hold the opposed portions together but to permit separation thereof from the opposed portions of the front panel, the back panel, the opposite sidewall panels and portions of the glue tab panel without damage thereto when a sufficient force is applied thereto.

A first portion comprising at least portions of the central body portion of the generally rectangular sheet of a relatively flexible fluid impervious material adjacent to one of the left and right side edges overlies but is not secured to at least portions of the unitary sheet of a relatively rigid material adjacent to one of the left and right side edges. In one preferred embodiment of the invention, a sheet of a relatively flexible material is secured to each of top and bottom body portions of the generally rectangular sheet of a relative flexible fluid impervious material.

An open ended enclosure is formed from the above described carton blank wherein a second portion of the carton blank comprising at least portions of the carton blank adjacent to the other of the left and right side edges is inserted between the non-secured portions of the first portion. At least portions of the relatively flexible fluid impervious material of the first portion are secured to at least portions of the relatively flexible fluid impervious material of the second portion by a relatively permanent adhesive and at least portions of the relatively rigid material of the first portion are secured to at least portions of the relatively rigid material of said second portion by a relatively permanent adhesive.

A carton is formed from the above-described open ended enclosure wherein the bottom body portion of the generally rectangular sheet of a relatively flexible fluid impervious material is folded and secured together and the bottom panel portions are folded and secured together to form a bottom closed end so that the carton can be filled with a desired material. Thereafter, the top body portion of the generally rectangular sheet of a relatively flexible fluid impervious material is folded and secured together and the top panel portions are folded and secured together to form a closed top end.

A method for forming an open ended enclosure from the above-described carton blank comprises folding the carton blank around the fold lines between the front and back panels, the opposite sidewall panels and the glue tab panel; inserting a second portion of the carton blank comprising at least portions of the carton blank adjacent to the other of the left and right side edges between the non-secured portions of the first portion; securing at least portions of the relatively flexible fluid impervious material of the first portion to at least portions of the relatively fluid impervious material of said second portion using a relatively permanent adhesive; and securing at least portions of the relatively rigid material of the first portion to at least portions of the relatively rigid material of the second portion using a relatively permanent adhesive.

The method further comprises forming a carton from the open ended enclosure by folding and sealing together portions of the bottom body portion of the generally rectangular sheet of a relatively flexible fluid impervious material; folding and securing together the bottom panel portions to form an open top carton having a bottom closed end; filling the open top end carton with a desired material; folding and securing together portions of the top body portion of the generally rectangular sheet of a relatively flexible fluid impervious material; and folding and securing together portions of the top panel portions.

BRIEF DESCRIPTION OF THE DRAWINGS

Illustrative and presently preferred embodiments of the invention are shown in the accompanying drawings in which.

DETAILED DESCRIPTION OF THE INVENTION

A carton blank is illustrated in FIGS. 1–4 The carton blank 402 has an outer layer comprising a unitary sheet 404 of a relatively rigid material and an inner layer of a generally rectangular sheet 406 of a relatively flexible fluid impervious material.

Figure 1:
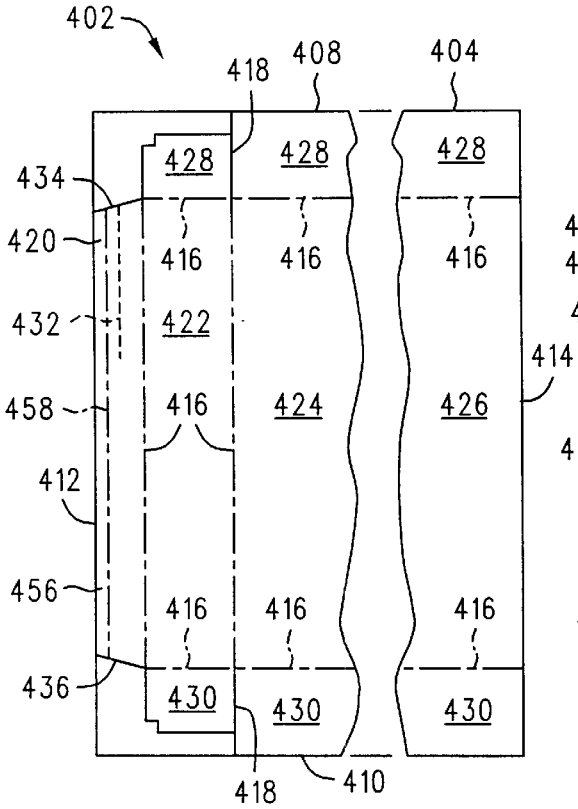
FIG. 1 is a plan view of a portion of the outer surface of a carton blank of a preferred embodiment of the invention.

As illustrated in FIG. 1 the unitary sheet 404 has a top edge 408, a bottom edge 410, a left side edge 412 and a right side edge 414. The unitary sheet 404 has a plurality of fold lines 416 and cut lines 418 to divided the unitary sheet into a glue tab panel 420, apposite sidewall panels 422 (only one of which is shown), a back panel 424, a front panel 426 (it is understood that these reference numerals could be reversed), a plurality of top panels 428 and a plurality of bottom panels 430. A perforated line 432 is formed in the glue tab panel 420 for purposes described below. The perforated line 432 is illustrated as terminating between the top edge 434 and the bottom edge 436 of the glue tab panel 420 but could extend completely to the bottom edge 436 for purposes described below.

Figure 2:
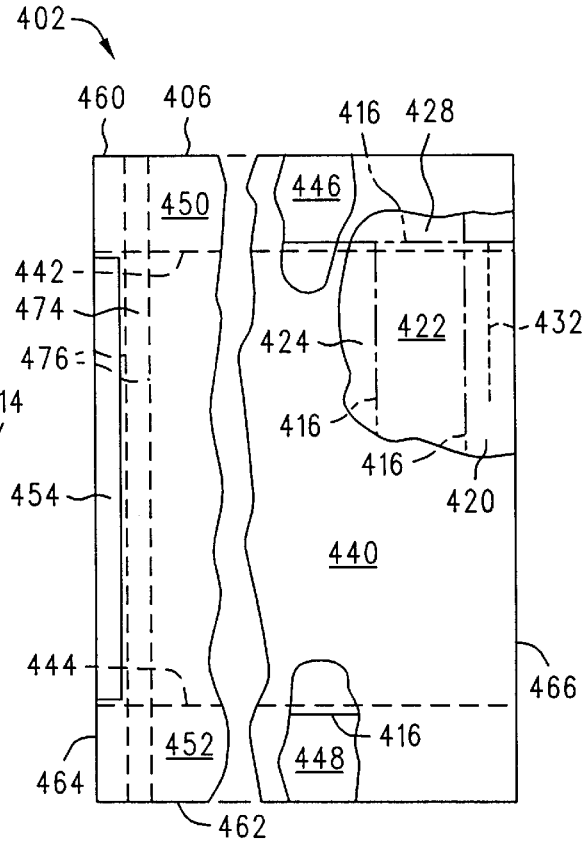
FIG. 2 is a plan view of the inner surface of FIG. 1.

As illustrated in FIG. 2, the generally rectangular sheet 406 has a central body portion 440 that is secured to the underlying central body portion of the unitary sheet 404 between the line 442 located slightly below the fold line 416 between the top panels 428, the sidewall panel 422 and the front and back panels 424 and 426 and the line 444 located slightly above the fold line 416 between the bottom panels 430 and the sidewall panel 422 and the front and back panels 424 and 426. The generally rectangular sheet 406 has a top body portion 450 and a bottom body portion 452. The unitary sheet 404 has corresponding underlying top and bottom body portions. Strips of a relatively flexible material 446 and 448 are secured to the top body portion 450 and the bottom body portion 452 of the generally rectangular sheet 406. During the manufacture of the carton blank 402, a portion 454 of the central body portion 440 is removed for purposes described below. This portion 454 is preferably removed by not adhering it to the unitary sheet 404 and then passing it over heating means. It is understood that other methods can be used to form the portion 454. Also, during the folding and gluing operation, a portion 456 of the glue tab panel 420, located between the perforated line 432 and the left side edge 412 and extending from the top edge 434 and the bottom edge 436, is skived away and a fold line 458 is formed therein for purposes described below. Preferably, the portion 456 is spaced a short distance from the perforated line 432. The generally rectangular sheet 406 has a top edge 460 a bottom edge 462, a left side edge 464 and a right side edge 466.

Figure 3:
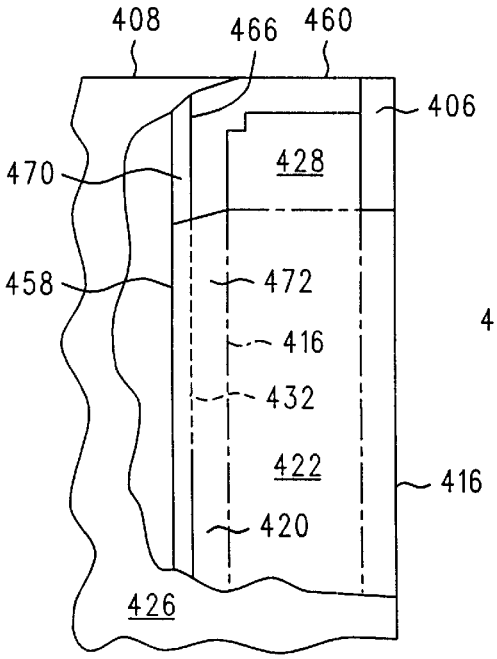
FIG. 3 is an enlarged view of a portion of the carton blank of FIGS. 1 and 2 after two folding operations.

In FIG. 3, there is illustrated the formation of an open ended enclosure from the carton blank 402. The glue tab panel 420 and the sidewall panel 422 have been folded around the fold line 416 between the sidewall panel 422 and the back panel 424. The portion of the generally rectangular sheet 406 and the top and bottom wall panels 428 and 430 integral with the sidewall panel 422 move therewith. The skived portion 456 is folded around the fold line 458 to form an exposed continuous strip 470 of the relatively flexible fluid impervious material. The front panel 426 is folded around the fold line between it and another sidewall panel (not shown) until the portion 454 overlies the portion 472 of the glue tab panel 420 and a strip 474, illustrated by the dashed lines 476 in FIG. 2, of the relatively flexible fluid impervious material overlies the continuous strip 470. The portions 454 and 472 are secured together, preferably by a relatively good adhesive bond, to hold the unitary sheet 404 of a relatively rigid material in a desired relationship. The strips 474 and 470 are secured together, preferably by a relatively good adhesive bond, to form a continuous inner enclosure with open ends of the generally rectangular sheet 406 of a relatively flexible fluid impervious material secured to the unitary sheet of a relatively rigid material.

When it is desired to form and fill a carton 480, the opposite sidewall panels 422 and the front and back wall panels 426 and 424 are formed into an open ended hollow rectangular shape. The adjacent portions of the bottom body portion 452 are folded and sealed together and the bottom panels 430 are folded and sealed together. The partially formed carton is then filled with a desired material. The adjacent portions of the top body portion 450 are folded and sealed together, such as illustrated in FIGS. 3 and 4, and folded down and the top panels 428 are folded and sealed together to form a filled carton.

When it is desired to remove material from the carton 480, the top panels 428, which have been secured together by a relatively weak adhesive bond are opened and then the adjacent portions of the top body portion 450, which also have been secured together by a relatively weak adhesive bond, are separated and the desired amount of material is removed. The adjacent portions of the top body portion 450 are then folded down into the carton and the top panels 428 are folded and held together by a conventional joint.

Figure 4:
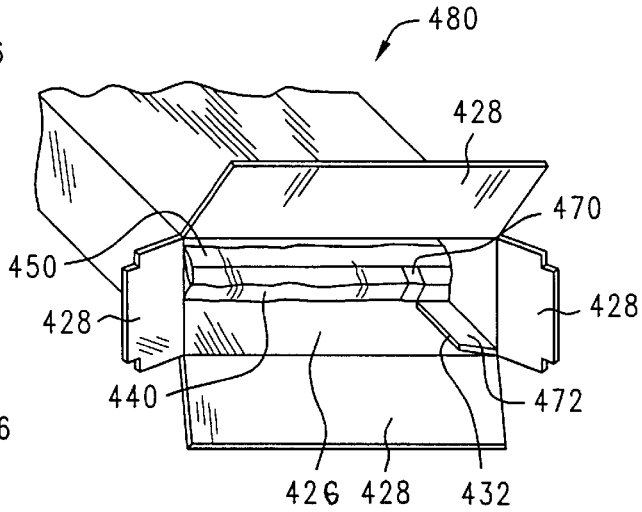
FIG. 4 is a perspective view of a carton formed from the carton blank of FIGS. 1 and 2 after some of the material contained therein has been removed.

In FIG. 4, there is illustrated the operation of the folding of the top body portion 450 into the carton 480. The central body portion 440 of the generally rectangular sheet 406 is secured to the central body portion of the unitary sheet 404 so that as the top and central body portions 450 and 440 are folded down into the carton 480, the continuous strip 470 and the folded together skived portion 456 will separate along the perforated line 432 and move with the central body portion 440. If desired, the perforated line 432 can extend from the top edge 434 to the body edge 436, so that, when all the material is removed from the carton 480, the generally rectangular sheet 406 may be completely separated from the unitary sheet 404 for separate disposal.

In FIGS. 5–10, there are described other preferred embodiments of the invention which are described using slightly different terminology.

Figure 5:
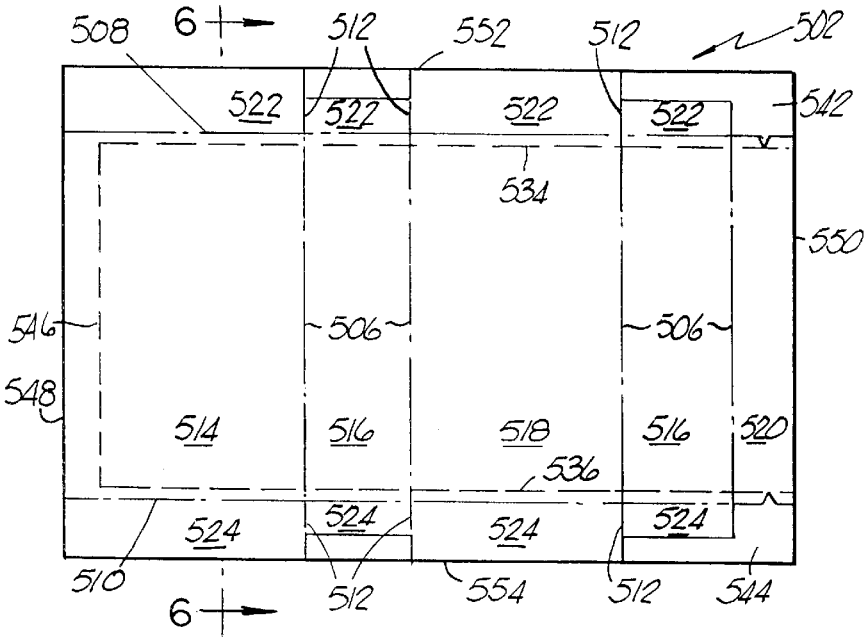
FIG. 5 is a plan view of the outer surface of a carton blank of another preferred embodiment of the invention.

In FIG. 5, there is disclosed a carton blank 502 comprising a unitary sheet 504 of a relatively rigid material having a plurality of fold lines 506, 508, 510 and cut lines 512 to divide the carton blank 502 into a back wall panel 514, sidewall panels 516, a front wall panel 518, a glue tab panel 520, top panels 522 and bottom panels 524. It is understood that the foregoing terminology is for description purposes only and the location and terminology of the various portions may be changed as desired.

A generally rectangular sheet 530 of a relatively flexible fluid impervious material has a central body portion 532 extending between the dashed lines 534 and 536 of FIG. 1, a top body portion 538 and a bottom body portion 540. A strip 542 of a relatively flexible material is secured to the top body portion 538 and a strip 544 of a relatively flexible material is secured to the bottom body portion 540. Portions of the central body portion 532 between the dashed lines 534 and 536 and 546 are secured to portions of the opposed portions of the front and back panels 518 and 514, the sidewall panels 516 and the glue tab panel 520 by an adhesive to hold the opposed portions together but to permit separation thereof for purposes described below. Portions of the unitary sheet 504 of a relatively rigid material and the generally rectangular sheet 530 of a relatively flexible fluid material have a common left side edge 548, a right side edge 550, a top edge 552 and a bottom edge 554.

Figure 8:
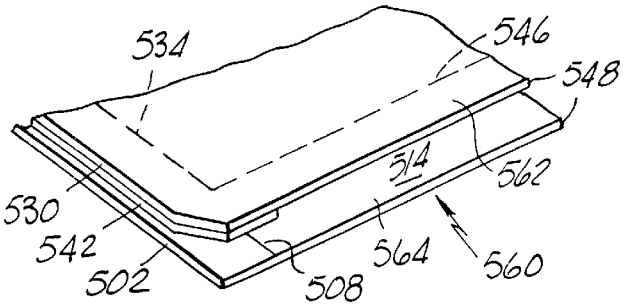
FIG. 8 is a perspective view of a portion of the carton blank of FIG. 5.

As illustrated in FIG. 8, a first portion 560 of the carton blank 502 comprises at least a portion 562 of the rectangular sheet 530 of a relatively flexible fluid impervious material between the left side edge 548 and the dashed line 546 overlying at least a portion 564 of the back panel 514 between the left side edge 548 and the dashed line 546. The at least a portion 562 and the at least a portion 564 are not secured together for purposes described below.

Figure 6:
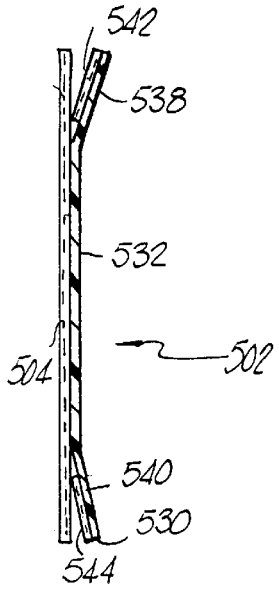
FIG. 6 is a cross-sectional view taken on the line 6—6 of FIG. 5.
Figure 7:
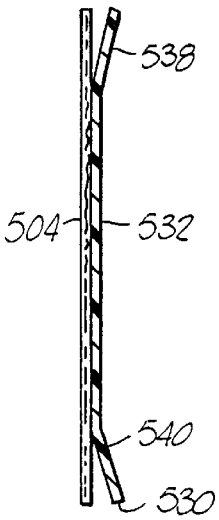
FIG. 7 is a cross-sectional view similar to FIG. 6 of another preferred embodiment of the invention.

In FIG. 7, there is illustrated another embodiment of the invention which embodiment is similar to that of FIG. 6 and corresponding parts have been identified with the same reference numerals. The strips 542 and 544 are not used in the embodiment of FIG. 7.

The unitary sheet 504 of a relatively rigid material is preferably formed from a conventional paperboard material or the composite material described in U.S. Pat. No. 4,254,173 to Peer, Jr., or other materials having similar characteristics. The generally rectangular sheet 530 of a relatively flexible fluid impervious material illustrated in FIG. 6 is preferably formed from a sheet of plastic material such as polypropylene or other materials having similar characteristics. The strips 542 and 544 preferably are formed from a conventional Kraft or recycled paper. The generally rectangular sheet 530 of a relatively flexible fluid impervious material in FIG. 7 can be the same as that in FIG. 6 or could be a kraft or recycled paper coated with a plastic material such as polyethylene or other materials having similar characteristics or a Kraft or recycled paper secured to a plastic material such as polyethylene or other materials having similar characteristics.

Figure 9:
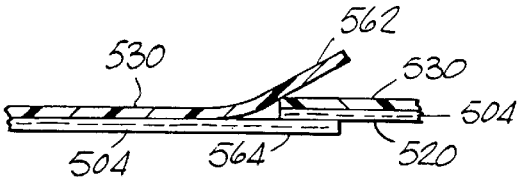
FIG. 9 is a sectional view of a portion of the carton blank of FIG. 5 at an intermediate step in the formation of an open ended enclosure from the carton blank of FIG. 5.
Figure 10:
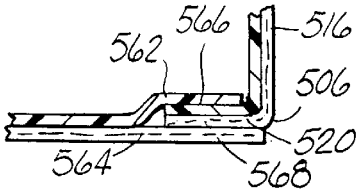
FIG. 10 is a sectional view of a portion of one corner of a carton formed from the carton blank of FIG. 5.

In FIG. 9, there is illustrated portions of the carton blank 502 in a partially folded condition to form an open ended enclosure. The glue tab panel 520 is being inserted between the at least a portion 562 and the at least a portion 564. In FIG. 10, there is illustrated one corner portion of a carton formed from the carton blank 502, wherein the at least a portion 562 has been secured with a relatively permanent adhesive to a portion 566 of the relatively flexible fluid impervious material 530 secured to the glue tab panel 520 and the at least a portion 564 has been secured with a relatively permanent adhesive to a portion 568 of the relatively rigid material 504. Also, the glue tab panel 520 and the sidewall panel 516 have been folded around the fold line 506.

An open ended enclosure is formed from the carton blank 502 by folding it around at least some of the fold lines 506 and inserting the glue tab panel 520 between the at least a portion 562 and the at least a portion 564. A relatively permanent adhesive is used to secure the at least a portion 562 to the portion 566 of the glue tab panel 520 and the at least a portion 564 to the portion 568 of the glue tab panel 520.

When it is desired to use the open ended enclosure, the carton blank 502 is folded around the fold lines 506 to form a rectangular opening. The bottom portion 540 is then folded and secured together in a conventional process. The bottom panels 524 are then folded and secured together in a conventional process to provide a carton having an open top end which carton is then filled with the desired material. After being filled, the top body portion 538 is folded and sealed together in a conventional process. The top panels 522 are then folded and sealed together in a conventional process.

The operation of the invention illustrated in FIGS. 5–10 is similar to that illustrated in FIG. 4. When it is desired to remove some of the material from the carton, the top panels 522 and the top body portion 538 are opened and the desired amount of the material is removed. The top body portion 538 is then folded and rolled downwardly toward the central body portion 532. As this motion is continued, the adhesive allows the central body portion 532 to be separated from the front and back panels 518 and 514 and the sidewall panels 516. This preserves the integrity of the relatively flexible fluid impervious material to provide the desired protection for the material remaining in the carton. When all the material has been removed from the carton, the generally rectangular sheet 530 of a relatively flexible fluid impervious material may be completely separated from the unitary sheet 504 of a relatively rigid material for separate disposal.

It is contemplated that the inventive concepts herein described may be variously otherwise embodied and it is intended that the appended claims be construed to include alternative embodiments of the invention except insofar as limited by the prior art.

What is claimed is:

1. A carton blank comprising:

a unitary sheet of a relatively rigid material having an inner surface and an outer surface;

said unitary sheet of a relatively rigid material having a left side edge, a right side edge, a top edge and a bottom edge;

said unitary sheet of a relatively rigid material having a length extending from said top edge to said bottom edge and a width extending from said left side edge to said right side edge;

said unitary sheet of a relatively rigid material having a plurality of cut and fold lines for dividing said unitary sheet of a relatively rigid material into a back wall panel, a front wall panel, opposite sidewall panels, a glue tab panel and top and bottom panels extending outwardly in opposite directions from said front wall, back wall and opposite sidewall panels;

said glue tab panel having a top edge and a bottom edge and a perforated line extending from said top edge toward said bottom edge;

said inner surface of said front wall panel, said back wall panel, said opposite sidewall panels and said glue tab panel having a central body portion, a top body portion and a bottom body portion;

said central body portion located between and spaced from said fold lines between said front wall panel, said back wall panel and said opposite sidewall panels and said top and bottom panels and extending into said glue tab panel;

a generally rectangular sheet of a relatively flexible fluid impervious material having an inner surface and an outer surface, a central body portion, a top body portion, a bottom body portion, a left side edge, a right side edge and top and bottom edges;

said generally rectangular sheet of a relatively flexible fluid impervious material having a length and a width corresponding to said length of said width of said unitary sheet of a relatively rigid material;

said central body portion of said rectangular sheet of a relatively flexible fluid impervious material being secured to said central body portion of said front wall panel, said back wall panel, said opposite sidewall panels and said glue tab panel;

at least portions of said central body portion of said generally rectangular sheet of a relatively flexible fluid impervious material being secured to adjacent portions of said central body portion of said front panel, said back panel, said opposite sidewall panels and portions of said glue tab panel by an adhesive holding said at least portions and said adjacent portions together but permitting separation thereof without damage thereto; and said top and bottom body portion of said generally rectangular sheet of a relatively flexible fluid impervious material overlying but not secured to said top and bottom body portion of said front wall panel, said back wall panel, said opposite sidewall panels and said glue tab panel and said top and bottom panels.

2. A carton blank comprising:

a unitary sheet of a relatively rigid material having an inner surface and an outer surface;

said unitary sheet of a relatively rigid material having a left side edge, a right side edge, a top edge and a bottom edge;

said unitary sheet of a relatively rigid material having a length extending from said top edge to said bottom edge and a width extending from said left side edge to said right side edge;

said unitary sheet of a relatively rigid material having a plurality of cut and fold lines for dividing said unitary sheet of a relatively rigid material into a back wall panel, a front wall panel, opposite sidewall panels, a glue tab panel and top and bottom panels extending outwardly in opposite directions from said front wall, back wall and opposite sidewall panels;

said glue tab panel having a top edge and a bottom edge;

a generally rectangular sheet of a relatively flexible fluid impervious material having an inner surface and an outer surface, a central body portion, a top body portion, a bottom body portion, a left side edge, a right side edge and top and bottom edges;

said generally rectangular sheet of a relatively flexible fluid impervious material having a length and a width corresponding to said length and said width of said unitary sheet of a relatively rigid material;

said central body portion of said rectangular sheet of a relatively flexible fluid impervious material being secured to opposite portions of said front wall panel, said back wall panel, said opposite sidewall panels and said glue tab panel;

at least portions of said central body portion of said generally rectangular sheet of a relatively flexible fluid impervious material being secured to said opposite portions of said front panel, said back panel, said opposite sidewall panels and portions of said glue tab panel by an adhesive holding said at least portions and said opposite portions together but permitting separation thereof without damage thereto; and a portion of said carton blank comprising at least portions of said central body portion of said generally rectangular sheet of a relatively flexible fluid impervious material adjacent to one of said left and right side edges overlying but not secured to at lest portions of said unitary sheet of a relatively rigid material adjacent to one of said left and right side edges.

3. A carton blank as in claim 2 and further comprising:

a sheet of a relatively flexible material secured to said top and bottom body portions of said generally rectangular sheet of a relative flexible fluid impervious material.

4. An open ended enclosure formed form a carton blank comprising a unitary sheet of a relatively rigid material having an inner surface and an outer surface; said unitary sheet of a relatively rigid material having a left side edge, a right side edge, a top edge and a bottom edge; said unitary sheet of a relatively rigid material having a length extending from said top edge to said bottom edge and a width extending from said left side edge to said right side edge; said unitary sheet of a relatively rigid material having a plurality of cut and fold lines for dividing said unitary sheet of a relatively rigid material into a back wall panel, a front wall panel, opposite sidewall panels, a glue tab panel and top and bottom panels extending outwardly in opposite directions from said front wall, back wall and opposite sidewall panels; said glue tab panel having a top edge and a bottom edge; a generally rectangular sheet of a relatively flexible fluid impervious material having an inner surface and an outer surface, a central body portion, a top body portion, a bottom body portion, a left side edge, a right side edge and top and bottom edges; said generally rectangular sheet of a relatively flexible fluid impervious material having a length and a width corresponding to said length and said width of said unitary sheet of a relatively rigid material; said central body portion of said rectangular sheet of a relatively flexible fluid impervious material being secured to opposite portions of said front wall panel, said back wall panel, said opposite sidewall panels and said glue tab panel; at least portions of said central body portion of said generally rectangular sheet of a relatively flexible fluid impervious material being secured to said opposite portions of said front wall panel, said back wall panel, said opposite sidewall panels and portions of said glue tab panel by an adhesive holding said at least portions and said opposite portions together but permitting separation thereof without damage thereto comprising:

a first portion comprising at least portions of said central body portion of said generally rectangular sheet of a relatively flexible fluid impervious material adjacent to one of said left and right side edges overlying but not secured to at least portions of said unitary sheet of a relatively rigid material adjacent to one of said left and right side edges comprising:

a second portion of said carton blank comprising at least portions of said carton blank adjacent to the other of said left and right side edges being located between said non-secured portions of said first portion;

at least portions of said relatively flexible fluid impervious material of said first portion being secured to at least portions of said relatively flexible fluid impervious material of said second portion; and at least portions of said relatively rigid material of said first portion being secured to at least portions of said relatively rigid material of said second portion.

5. A carton formed from the open ended enclosure of claim 4 comprising:

said bottom body portion of said generally rectangular sheet of a relatively flexible fluid impervious material being folded and secured together and said bottom panel portions being folded and secured together to form a bottom closed end so that the carton can be filled with a desired material; and said top body portion of said generally rectangular sheet of a relatively flexible fluid impervious material being folded and secured together after said carton has been filled, and said top panel portions being folded and secured together to form a closed top end.

6. A method for forming an open ended enclosure from a carton blank comprising a unitary sheet of a relatively rigid material having an inner surface and an outer surface; said unitary sheet of a relatively rigid material having a left side edge, a right side edge, a top edge and a bottom edge; said unitary sheet of a relatively rigid material having a length extending from said top edge to said bottom edge and a width extending from said left side edge to said right side edge; said unitary sheet of a relatively rigid material having a plurality of cut and fold lines for dividing said unitary sheet of a relatively rigid material into a back panel, a front panel, opposite side wall panels, a glue tab panel and top and bottom panels extending outwardly in opposite directions from said front, back and opposite sidewall panels; said glue tab panel having a top edge and a bottom edge; a generally rectangular sheet of a relatively flexible fluid impervious material having an inner surface and an outer surface, a central body portion, a top body portion, a bottom body portion, a left side edge, a right side edge and top and bottom edges; said generally rectangular sheet of a relatively flexible fluid impervious material having a length and a width corresponding to said length of said width of said unitary sheet of a relatively rigid material; said central body portion of said rectangular sheet of a relatively flexible fluid impervious material being secured to opposite portions of said front panel, said back panel, said opposite sidewall panels and said glue tab panel; at least portions of said central body portion of said generally rectangular sheet of a relatively flexible fluid impervious material being secured to said opposite portions of said front panel, said back panel, said opposite sidewall panels and said glue tab panel by an adhesive holding said at least portions and said opposite portions together but permitting separation thereof without damage thereto, and having a first portion comprising at least portions of said central body portion of said generally rectangular sheet of a relatively flexible fluid impervious material adjacent to one of said left and right side edges overlying but not secured to at least portions of said unitary sheet of a relatively rigid material adjacent to one of said left and right side edges comprising:

folding said carton blank around at least some of said fold lines between said front and back panels, said opposite sidewall panels and said glue tab panel;

inserting a second portion of said carton blank comprising at least portions of said carton blank adjacent to the other of said left and right side edges between said non-secured portions of said first portion;

securing at least portions of said relatively flexible fluid impervious material of said first portion to at least portions of said relatively fluid impervious material of said second portion; and securing at least portions of said relatively rigid material of said first portion to at least portions of said relatively rigid material of said second portion.

7. A method as in claim 6 and further comprising:

forming a carton from said open ended enclosure comprising;

folding and sealing together portions of said bottom body portion of said generally rectangular sheet of a relatively flexible fluid impervious material;

folding and securing together said bottom panel portions to form a carton having an open top end and a bottom closed end;

filling said carton with a desired material;

folding and securing together portions of said top body portion of said generally rectangular sheet of a relatively flexible fluid impervious material; and folding and securing together portions of said top panel portions.

* * * * *

UNITED STATES PATENT AND TRADEMARK OFFICE

CERTIFICATE OF CORRECTION

PATENT NO. : 5,918,799

DATED : July 6, 1999

INVENTOR(S) : Joseph C. Walsh

It is certified that error appears in the above-identified patent and that said Letters Patent is hereby corrected as shown below:

| | |
|---|---|
| Column 2, Line 37: | Delete "form" and insert therefor --from-- |
| Column 2, Line 46: | Delete "on" and insert therefor --one-- |
| Column 2, Line 50: | Delete "is" and insert therefor --to-- |
| Column 3, Line 7: | Delete "opened" and insert therefor --open-- |
| Column 3, Line 51: | Delete "formed" and insert therefor --form-- |
| Column 3, Line 60: | After "portions" insert --of-- |
| Column 4, Line 1: | Delete "form" and insert therefor --from-- |
| Column 4, Line 1: | Delete "comprise" and insert therefor --comprises-- |
| Column 4, Line 8: | Delete "tope" and insert therefor --top-- |
| Column 4, Line 20: | After second "portion" insert --,-- |
| Column 5, Line 61: | After "FIGS. 1-4" insert --.-- |
| Column 6, Line 2: | Delete "divided" and insert therefor --divide-- |
| Column 6, Line 3: | Delete "apposite" and insert therefor --opposite-- |
| Column 6, Line 40: | After "460" insert --,-- |
| Column 8, Line 18: | Delete "kraft" and insert therefor --Kraft-- |

UNITED STATES PATENT AND TRADEMARK OFFICE

CERTIFICATE OF CORRECTION

PATENT NO. : 5,918,799

DATED : July 6, 1999

INVENTOR(S) : Joseph C. Walsh

It is certified that error appears in the above-identified patent and that said Letters Patent is hereby corrected as shown below:

IN THE CLAIMS

Column 10, Line 50: Delete "lest" and insert therefor --least--

Column 10, Line 56: Delete "relative" and insert therefor --relatively--

Column 10, Line 57: Delete "form" and insert therefor --from--

Column 12, Line 4: Delete "side wall" and insert therefor --sidewall--

Signed and Sealed this

Twenty-third Day of May, 2000

*Attest:*

Q. TODD DICKINSON

*Attesting Officer*

*Director of Patents and Trademarks*